US006164845A

United States Patent [19]

Earle et al.

[11] Patent Number: 6,164,845

[45] Date of Patent: Dec. 26, 2000

[54] PROCESSING PHOTOGRAPHIC MATERIAL

[75] Inventors: Anthony Earle, Harrow Weald; Andrew Sewell, Watford, both of United Kingdom; Sheridan Vincent, Rochester, N.Y.

[73] Assignee: Eastman Kodak Company, Rochester, N.Y.

[21] Appl. No.: 09/167,939

[22] Filed: Oct. 6, 1998

[30] Foreign Application Priority Data

Oct. 17, 1997 [GB] United Kingdom ..... 9721979

[51] Int. Cl.[7] ..... G03D 13/00

[52] U.S. Cl. ..... 396/568; 396/578

[58] Field of Search ..... 396/568, 569, 396/570, 578, 626

[56] References Cited

U.S. PATENT DOCUMENTS 4,329,042 5/1982 Libicky et al. ..... 396/626

4,346,981 8/1982 Kaufmann ..... 396/626

FOREIGN PATENT DOCUMENTS 0 251 178 1/1988 European Pat. Off. .

0 530 619 3/1993 European Pat. Off. .

0 563 989 10/1993 European Pat. Off. .

*Primary Examiner*—D. Rutledge

*Attorney, Agent, or Firm*—Frank Pincelli

[57] ABSTRACT

Processing of photographic material is carried out by sensing the quantity of material passing through a processor and supplying replenishment solution in accordance therewith. The level of solution in the processing tanks is also sensed during processing, and a second solution is supplied in the event that the level falls below a predetermined value. The second solution is less concentrated than the normal replenishment solution, thereby to maintain the chemical activity of the tank closer to its required, seasoned state. Furthermore, by controlling the solution levels during processing, less replenishment solution need be added during normal replenishment, thus minimizing the amount of solutions needed.

9 Claims, 1 Drawing Sheet

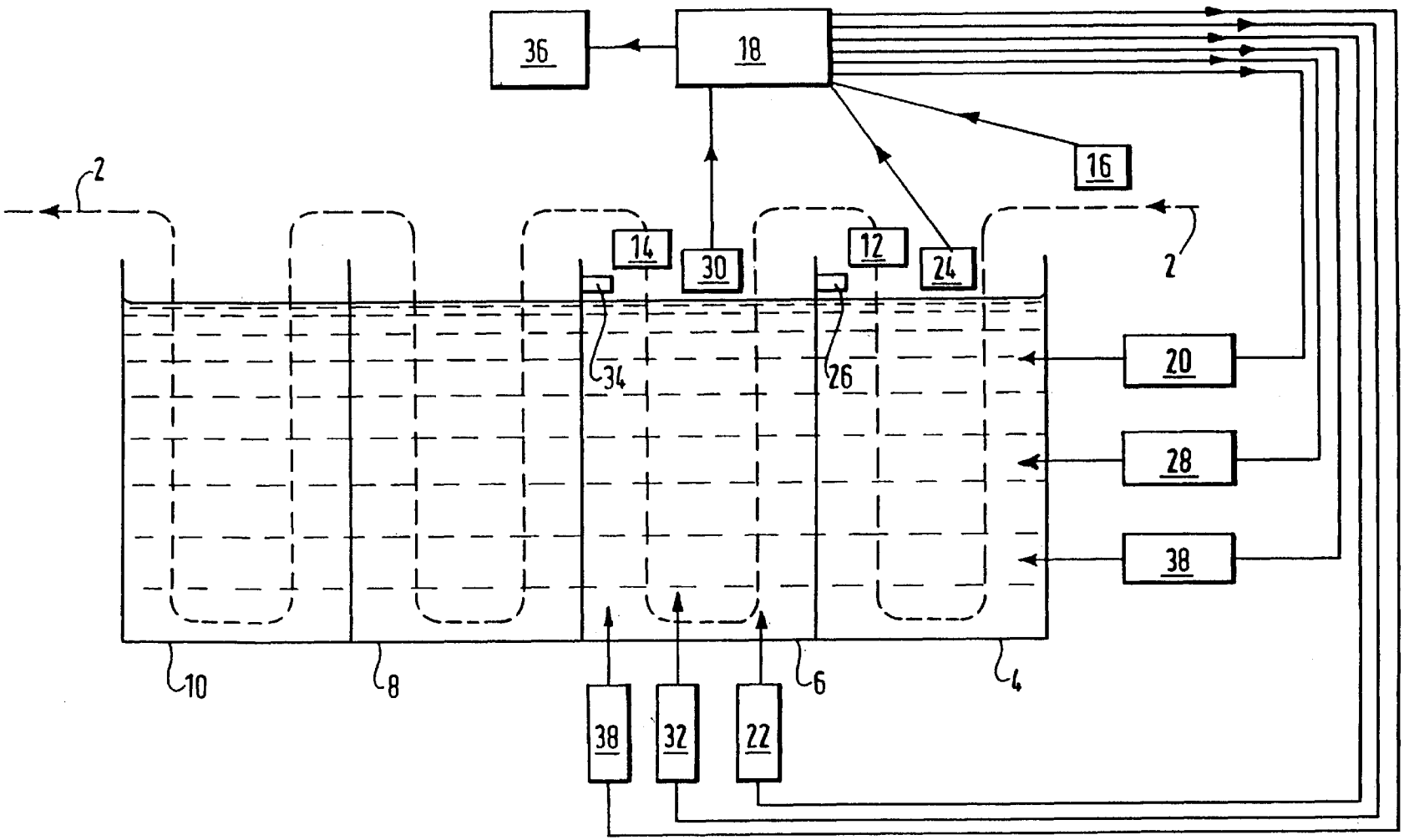
2
16
20
28
38
24
12
26
4
6
18
30
22
32
14
34
38
36
8
10
2

PROCESSING PHOTOGRAPHIC MATERIAL

FIELD OF THE INVENTION

This invention relates to processing photographic material, and in particular to a method of and apparatus for processing in which supply of solution to a photographic processor is in accordance with sensed processing parameters.

BACKGROUND OF THE INVENTION

It is known to supply photographic processors, in which sensitized photographic material is passed through tanks containing processing solution, with replenishment solution from time-to-time in accordance with the quantity of material as measured passing therethrough in order to maintain the activity of the processing solution. Usually, the type of material being processed is also noted and the amount of replenishment adjusted accordingly. Furthermore, processors are inspected by operators from time-to-time, usually before they are brought into operation after a shutdown, to ensure that the solutions in the tanks are up to the required levels.

Tanks, of whatever configuration, of photographic processors are typically replenished with an excess quantity of solution in order to ensure that the required minimum levels are maintained at all times. This excess arises for several reasons, for example: (a) to avoid the need for frequent inspection of the tank levels by the operator; (b) to offset the carryover of solution by the material from one tank to the next, which may be excessive, or may gradually increase with time, due to wear of squeegees located at tank exits; and (c) the need to offset any loss due to minor leakage that might not immediately be noticed. At least some of the excess solution may immediately go to waste through an overflow pipe. This loss is clearly an unwanted initial cost, but it is also a cost in terms of the need to dispose of and/or reclaim undesirable or expensive materials, and thus can be an environmental problem.

It is one object of the present invention to provide control of photographic processing such that consumption of processing solutions and production of waste solutions are reduced. It is another object of the invention to provide processing control such that the chemical activity of the processor is maintained in a more consistent state.

SUMMARY OF THE INVENTION

In accordance with one aspect of the present invention, there is provided a method of processing photographic material, which may be sensitized film or paper, wherein the quantity of material passing through a tank of a photographic processor containing processing solution is sensed and the solution therein is replenished with a first solution after a predetermined quantity of material has been processed, and wherein, during processing of the material, the level of the solution in the tank is sensed and the solution therein is replenished with a second solution when the level falls below a predetermined level.

Thus, by sensing the solution level in a processing tank and supplying a second solution when a low level is detected, less solution need be supplied at the normal replenishment stages. Furthermore, a solution that is different from the normal replenishment solution is added in response to a low tank level. In this respect, it is to be noted that passage of photographic material through, and the supply of replenishment solution to, a processor "conditions" the tanks over time. The processing conditions, such as quantity and strength of solutions supplied, and the speed of transport of the material through the processor, and thus its residence time therein, are set to correspond to steady-state operating conditions. In certain instances, therefore, addition of a normal replenishment solution may cause divergence from the desired steady-state to a new condition, and this could particularly happen if normal replenishment solution were to be added in response to a fall in level of solution in a tank. The present invention provides for a different solution to be supplied in response to fall in level from that supplied in response to the quantity of material processed. Simply to add further normal replenishment solution at a time of low level would result in the strength of the processing solution in the tank exceeding its conditioned state. Thus, in accordance with the invention, a second, different solution is supplied, namely one that is less concentrated. Preferably, the second solution is a mixture of the normal replenishment solution and another solution. The other solution may conveniently be a so-called "starter" or converter solution.

The tank levels may also fall when a processor is not active, for example when switched off overnight. However, in such a condition, and excluding leakage that may be detectable by other means, the likely reason is evaporation. That is to say, the solution will have lost water, thus becoming more concentrated. In accordance with the invention, preferably the operating condition of the processor is sensed, and should a low level indication be derived when photographic material is not being processed, then a solution that consists substantially of water may be supplied to the tank.

If during processing a tank needs to be supplied with the second solution, this may be due to wear in the squeegees, or other solution remover, associated with that tank—squeegees being conventionally arranged to remove excess solution from the material as it leaves one tank before passing into the next. In this event, excessive solution from the said tank, a developing tank for example, is being carried over by the material into the next tank, a bleach tank for example, with a detrimental effect on the processing in the second tank. In accordance with the invention, the low level indication from the said tank may be used when material is being processed, to modify, for example to strengthen, the solution supplied to the second tank so as to ensure the correct chemical activity for processing of the material therein. Clearly, this control may be extended to further tanks, and may also operate in a feedback mode as well as in the feedforward mode described.

In accordance with a further aspect of the present invention, there is provided apparatus for processing photographic material, comprising:

- means for sensing the quantity of material passing through a tank of a photographic processor containing processing solution, and for indicating when a predetermined quantity of the material has been processed;
- means for supplying replenishment solution to the tank in response to the indication from the quantity sensing means;
- means for sensing the level of solution in the tank, and for indicating when the level falls below a predetermined level; and
- means for supplying a second solution to the tank during processing of the material, in response to the indication from the level sensing means.

The level sensing means is preferably located in an upper region of the tank, and preferably in the vicinity of an overflow outlet so that the normal level of a full tank can be maintained.

Preferably, the apparatus is such as to carry out the method of the invention.

The tank may have any suitable configuration, for example being a conventional deep tank for large scale processing, or as used in minilabs or microlabs, or the newer low volume tanks. The tank may be formed as a channel, for example of generally U- or V-shape, in a larger container.

It is to be understood that each sensing means may provide an indication of the parameter sensed in any convenient manner. This may be by providing a signal as to its absolute value or that the parameter has strayed beyond one or more predetermined values. In the latter instance, an indicator light may be activated, or deactivated, or a sound signal produced. Additionally, or alternatively, the indication may be stored for subsequent review, on a printout, for example.

The finer level of control of photographic processing that is provided by the present invention thus allows a reduction to be made in the amount of normal replenishment solution that is supplied in accordance with the quantity of material processed. Less solution overflows into a waste, or reclaim, pipe, and the solution to which the material is subjected is maintained at or nearer to the optimum parameters at all times. In the latter respect, it is to be noted that real time adjustment can be made not only in respect of a tank that has a level problem, but that this information can be used in a feed forward or feed back mode to modify processing of the material at another stage to take into account a change in the carryover.

By monitoring the frequency of supply of the second solution, wear rate on squeegees, or other processor components that could result in a fall in the level of solution in a tank, can be identified. Furthermore, by fitting more than one tank of a processor with such level control, the location of a problem can be identified, thus facilitating maintenance and/or repair.

BRIEF DESCRIPTION OF THE DRAWINGS

Apparatus for, and a method of, processing photographic material, each in accordance with the present invention, will now be described, by way of example, with reference to the accompanying drawing, which is a schematic elevation of a photographic processor.

DETAILED DESCRIPTION OF THE INVENTION

Referring to the drawing, an exposed sensitized photographic film 2 is shown following a broken line path through a conventional photographic processor that comprises deep tanks each containing respective processing solution. The film 2 initially enters a developer tank 4, then passes through a bleach tank 6 before entering a wash stage, exemplified by two wash tanks 8 and 10. It will be appreciated that the number of tanks in any processing stage may be different from that exemplified herein. A squeegee 12 removes excess developer solution from the surface of the film 2 as it passes from the developer tank 4 into the bleach tank 6 and returns it to the tank 4, and a further squeegee 14 performs a corresponding task as the film 2 passes from the bleach tank 6 into the first wash tank 8.

A sensor 16 measures the surface area of film 2 as it enters the processor. This may be done actually by measuring the width and then combining this information with the speed of passage of the film 2 to determine when a predetermined surface area has been processed, or by direct measurement of the area. The type of film 2 being processed is also noted. This information may be fed to, stored, or derived in, a process controller 18, a personal computer, for example. When the predetermined quantity of film has been processed for the given type, the controller 18 sends a signal for the supply of normal strength and amount of replenishment solution to the developer tank 4 from a store 20. This may be a pre-mixed solution, or alternatively may be a succession of concentrates and water that are added directly to the tank 4. This amount is just sufficient to counteract the amount used up in processing that quantity and type of film 2 and to offset the amount estimated to be carried over by the film into the bleach tank 6 after removal of excess by the efficient operation of the squeegee 12. The controller 18 similarly controls replenishment, in accordance with the output of the sensor 16, of the tank 6 with bleach solution from a store 22, taking into account the amount returned to the tank 6 by the squeegee 14.

A sensor 24 is associated with the developer tank 4 so as to detect the level of the solution therein, and is arranged so as to provide a signal to the controller 18 whenever the solution drops below a predetermined level. To minimize the amounts of solution used in the processor, the predetermined level is set close to the level of an overflow pipe 26 of the tank 4. The controller 18 also receives a signal indicating whether or not the processor is actually processing photographic material. This signal may come from the film quantity sensor 16, or from another source elsewhere in the processor (not shown). In the event that the controller 18 receives input that the processor is processing photographic material, such as the film 2, and input from the sensor 24 that the solution in tank 4 is below its predetermined level, then the controller 18 sends a signal to a level top-up store 28 to supply a solution to tank 4. Store 28 contains a solution that is a mixture of the normal replenishment solution, as in store 20, and a starter solution, and this is used to bring the level of solution in tank 4 to its proper value whilst maintaining substantially the same chemical activity in the tank 4. While this solution may be pre-mixed, it may alternatively be provided as a succession of concentrates, some of which may be shared with store 20, and water added directly to the tank 4. Normal replenishment from the store 20 will still occur in dependence on the quantity signal from the sensor 16, and this will, from time-to-time, result in overflow through the pipe 26. However, this will still be less then in conventional processing, due to the reduced amount supplied from the store 20 in response to output from the quantity sensor 16.

A level sensor 30 is associated with the bleach tank 6 and co-operates in an analogous manner with the controller 18 to supply reduced-strength top-up solution from a store 32 so as to maintain the level in the tank 6 just below its overflow pipe 34.

In this way, the levels and activities of the tanks 4 and 6 can be maintained accurately with the minimum of solution supplied thereto and overflowing therefrom, and this can be done even in the event of loss from the tanks for any reason. Barring leakage, which may be detected by additional, conventional liquid detectors, the expected major reason for activation of the level sensors 24 and 30 is wear of the squeegees 12 and 14, resulting in excessive carryover of solution from one tank to the next by the film 2. The controller 18 can be arranged to indicate on a display 36 information relating to the frequency of receipt of indications from the level sensors, to ensure that the squeegees 12 and 14 are at least checked at appropriate intervals by the processor operator.

It will be appreciated that the level sensing and control of supply of solution described with reference to tanks 4 and 6 can also be applied to the wash stage. In this respect, for example, when excessive carryover is detected by the sensor 30 from the bleach tank 6 into the first wash tank 8, the controller 18 may arrange for additional wash solution to be supplied to the wash stage. Advantageously, washing is carried out in counter current mode, so that in this case, when excessive carryover is sensed from the bleach tank 6 into the first wash tank 8, the controller 18 will arrange for an increase in the supply of wash water into the second wash tank 10.

When the sensor that senses the operating condition of the processor determines that no photographic material is being processed, and when one or more of the level sensors indicates too low a level in a tank, then the controller 18 sends a signal to supply water from a store 38 to the relevant tank(s), on the basis that the problem is due to evaporation. In this way, start-up of the processor, for example, after an overnight shutdown, can take place in a much shorter time since the correct levels can be maintained constantly.

The invention has been described in detail with particular reference to preferred embodiments thereof, but it will be understood that variations and modifications can be effected within the spirit and scope of the invention.

PARTS LIST

2 Photographic film
4 Developer tank
6 Bleach tank
8 Wash tank
10 Wash tank
12 Squeegee
14 Squeegee
16 Sensor
18 Controller
20 Store
22 Store
24 Sensor
26 Pipe
28 Store
30 Sensor
32 Store
34 Pipe
36 Display
38 Store

What is claimed is:

1. A method of processing photographic material wherein the quantity of material passing through a tank of a photographic processor containing processing solution is sensed and the solution therein is replenished with a first solution after a predetermined quantity of material has been processed, and wherein, during processing of the material, the level of the solution in the tank is sensed and the solution therein is replenished with a second solution when the level falls below a predetermined level.

2. A method according to claim 1, wherein the second solution comprises a mixture of the first solution and a third solution.

3. A method according to claim 1, wherein the operating condition of the processor is sensed and when (a) the sensed operating condition is that the processing tank is not processing photographic material, and (b) the sensed processing solution level is below the predetermined level, a solution consisting substantially of water is added to the tank.

4. A method according to claim 2, wherein the operating condition of the processor is sensed and when (a) the sensed operating condition is that the processing tank is not processing photographic material, and (b) the sensed processing solution level is below the predetermined level, a solution consisting substantially of water is added to the tank.

5. A method according to claim 1, wherein a further processing solution is supplied to a second tank into which the photographic material passes from the said tank, and wherein on said supply of the second solution to the said tank, supply of the further solution is modified.

6. Apparatus for processing photographic material, comprising:

means for sensing the quantity of material passing through a tank of a photographic processor containing processing solution, and for indicating when a predetermined quantity of the material has been processed;

means for supplying replenishment solution to the tank in response to the indication from the quantity sensing means;

means for sensing the level of solution in the tank, and for indicating when the level falls below a predetermined level; and means for supplying a second solution to the tank during processing of the material, in response to the indication from the level sensing means.

7. Apparatus according to claim 6, comprising means for sensing the operating condition of the processor to provide an indication when the tank is not processing photographic material; and means for supplying to the tank a solution consisting substantially of water on receipt of said indications from both of said level and operating condition sensing means.

8. Apparatus according to claim 6, comprising means for supplying solution to a second tank of the processor, and means arranged to modify said supply to the second tank in response to the indication from the level sensing means of the said tank.

9. Apparatus according to claim 6, comprising means for supplying solution to a second tank of the processor, and means arranged to modify said supply to the second tank in response to the indication from the level sensing means of the said tank.

* * * * *